US010041311B2

(12) United States Patent
In

(10) Patent No.: US 10,041,311 B2
(45) Date of Patent: Aug. 7, 2018

(54) ROD CLAMPING DEVICE

(71) Applicant: Suk Shin In, Gwangju (KR)

(72) Inventor: Suk Shin In, Gwangju (KR)

( * ) Notice: Subject to any disclaimer, the term of this patent is extended or adjusted under 35 U.S.C. 154(b) by 0 days.

(21) Appl. No.: 15/319,392

(22) PCT Filed: Jun. 18, 2015

(86) PCT No.: PCT/KR2015/006218
§ 371 (c)(1),
(2) Date: Dec. 16, 2016

(87) PCT Pub. No.: WO2015/194898
PCT Pub. Date: Dec. 23, 2015

(65) Prior Publication Data

US 2017/0130538 A1 May 11, 2017

(30) Foreign Application Priority Data

Jun. 18, 2014 (KR) ..... 10-2014-0074614
Jun. 18, 2015 (KR) ..... 10-2015-0086992

(51) Int. Cl.
*E21B 19/06* (2006.01)
*E21B 3/02* (2006.01)

(52) U.S. Cl.
CPC ..... *E21B 19/06* (2013.01); *E21B 3/02* (2013.01)

(58) Field of Classification Search
CPC ..... E21B 19/06; E21B 3/02
(Continued)

(56) References Cited

U.S. PATENT DOCUMENTS 1,021,205 A * 3/1912 Mills ..... E21B 23/01 166/216
6,155,576 A 12/2000 Yorde
(Continued)

FOREIGN PATENT DOCUMENTS

KR 10-2011-0068998 A 6/2011
KR 10-2012-0003264 A 1/2012
(Continued)

OTHER PUBLICATIONS

Office Action in related Korean Patent Application.
(Continued)

*Primary Examiner* — D. Andrews
*Assistant Examiner* — Dany E Akakpo
(74) *Attorney, Agent, or Firm* — Eric L. Lane; Green Patent Law

(57) ABSTRACT

The present invention relates to a rod clamping device, and a rod clamping device for clamping a rod to a driving shaft provided at a head part moving along a lead of a boring machine comprises: a housing coupled to the driving shaft; a locking member screw-coupled to the housing and moving forward and backward according to the forward and reverse rotations of the housing coupled to the driving shaft; a supporting part supported by the housing; and a collet unit extended from the supporting part and inserted into a hollow part of the rod, and including a plurality of collet parts for holding and releasing the rod according to the forward and backward movements of the locking member. The rod clamping device, according to the present invention, can hold the rod by expanding the outer diameter of the collet unit inserted into the rod, and thus can more easily replace the rod. In addition, since the rod is coupled to the driving shaft of the head part by the collet unit, wear and breakage of the rod and the driving shaft caused by frequent replace-
(Continued)

ment of the rod or excessive fastening of the rod can be prevented.

4 Claims, 7 Drawing Sheets

(58) Field of Classification Search
USPC ..... 294/86.25; 166/85.1
See application file for complete search history.

(56) References Cited

U.S. PATENT DOCUMENTS

| | | | | |
|---|---|---|---|---|
| 2008/0210063 | A1* | 9/2008 | Slack | E21B 19/06 81/420 |
| 2013/0062048 | A1* | 3/2013 | Hult | E21B 19/12 166/85.1 |

FOREIGN PATENT DOCUMENTS

| | | | |
|---|---|---|---|
| KR | 10-2012-0033954 | A | 4/2012 |
| KR | 10-2012-0100798 | A | 9/2012 |
| KR | 10-2012-0120624 | A | 11/2012 |
| KR | 10-2014-0030028 | A | 3/2014 |

OTHER PUBLICATIONS

International Search Report dated Sep. 1, 2015 in related International Application No. PCT/KR2015/006218.
English translation of International Search Report dated Sep. 1, 2015 in related International Application No. PCT/KR2015/006218.
Written Opinion dated Sep. 1, 2015 in related International Application No. PCT/KR2015/006218.

* cited by examiner

ROD CLAMPING DEVICE

TECHNICAL FIELD

The present invention relates to a rod clamping device, and more particularly, to a rod clamping device capable of clamping a rod to a drive shaft provided at a head part of a boring machine.

BACKGROUND ART

Generally, a boring machine is a device which drills a deep hole from the ground into the underground for purposes of drilling, soil testing, or development of underground water.

A conventional boring machine is disclosed in Korean Patent Registration No. 10-0624233.

The conventional boring machine includes a body having a driving device such as an engine, a leader supported by the body, and a head sliding along the leader and generating an elevational force or a rotational force by the driving device provided in the body, a rod coupled to the head and being elevated or rotated by the head, and a drilling unit provided at a front end of the rod and drilling the ground while elevating or rotating along with the rod.

The drilling unit includes a bit that drills by striking the ground, and a hammer operated by a fluid pressure to provide a striking force to the bit. Further, the fluid pressure can be transferred to the drilling unit by installing a separate hydraulic line on the rod.

Such a boring machine drills the ground to a predetermined depth through the bit of the drilling unit rotating or striking the ground. When the ground is drilled, the drilling unit and the rod are introduced into the ground. The rod is connected to the drilling unit as much as a depth where the rod is introduced into the ground to extend the length of the rod.

However, since the rod is screw-coupled to the head part in the conventional boring machine, a thread of the drive shaft is worn due to frequent replacement of the rod or the rod or the drive shaft is broken because of excessive fastening of the rod.

DISCLOSURE

Technical Problem

The present invention is proposed to overcome the above-described problem, and has the object of providing a rod clamping device that is capable of holding a rod by expanding an outer diameter of a collet unit inserted into the rod.

Technical Solution

In order to achieve the above-described objective, a rod clamping device according to the present invention for clamping a rod to a driving shaft provided at a head part moving along a lead of a boring machine includes: a housing coupled to the driving shaft; a locking member screw-coupled to the housing and moving forward and backward according to forward and reverse rotations of the housing coupled to the driving shaft; a supporting part supported by the housing; and a collet unit extended from the supporting part and inserted into a hollow part of the rod, and including a plurality of collet parts for holding and releasing the rod according to the forward and backward movements of the locking member.

Preferably, a plurality of guide grooves extended in a forward-and-backward movement direction of the locking member are formed on an outer circumference surface of the locking member and the collet parts are introduced therein, and a contact surface of each of the guide grooves which contacts an inner surface of the collet part is obliquely formed at a predetermined angle with respect to a center line of the forward-and-backward direction of the locking member and the collet parts approach or are spaced apart from a center of the locking member in accordance with the forward and backward movement of the locking member.

A plurality of anti-slip protrusions are formed on outer circumferential surfaces of the collet parts to prevent slipping with respect to an inner circumferential surface of the rod, and an inner surface of each of the collet parts is obliquely formed at an angle corresponding to a tilt angle of a contact surface of the locking member to move in a direction orthogonal to the center line of the forward-and-backward direction of the locking member in accordance with the forward and backward movement of the locking member.

The housing includes: a main body which has an end portion coupled to the drive shaft to rotate with the drive shaft and has a fastening hole formed to penetrate therein along a length direction of the lead to be screw-coupled to the locking member; and a sub body which is coupled to the other end portion of the main body and supports the supporting part to be rotatable with respect to a center line of the length direction.

Preferably, a supply channel is formed on the locking member to penetrate therein along a length direction of the lead and a working fluid injected through the drive shaft of the head part is supplied to the rod.

Advantageous Effects

The rod clamping device according to the present invention can hold a rod by expanding an outer diameter of a collet unit inserted into the rod, and thus can more easily replace the rod. In addition, since the rod is coupled to the driving shaft of the head part by the collet unit, wear and breakage of the rod and the driving shaft caused by frequent replacement of the rod or excessive fastening of the rod can be prevented.

MODES OF THE INVENTION

Figure 1:
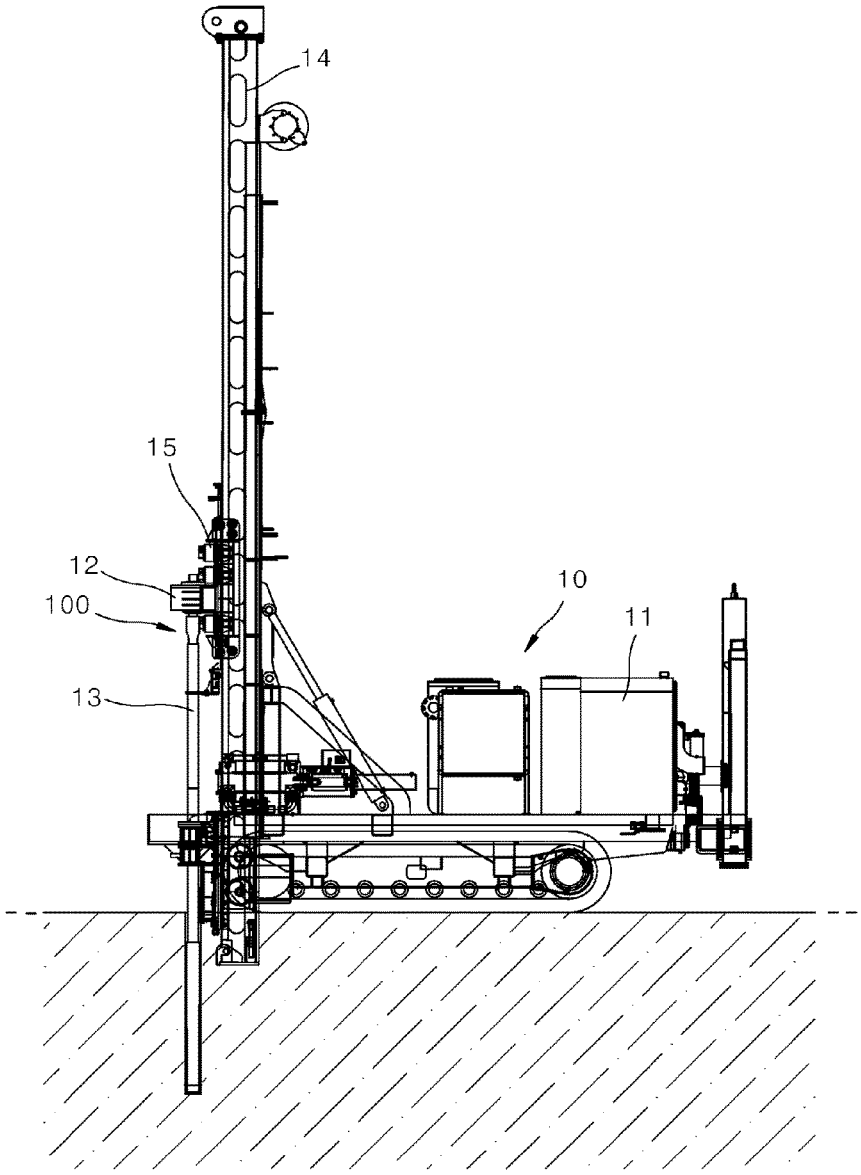
FIG. 1 is a lateral view of a boring machine to which a rod clamping device according to the present invention is mounted.
Figure 2:
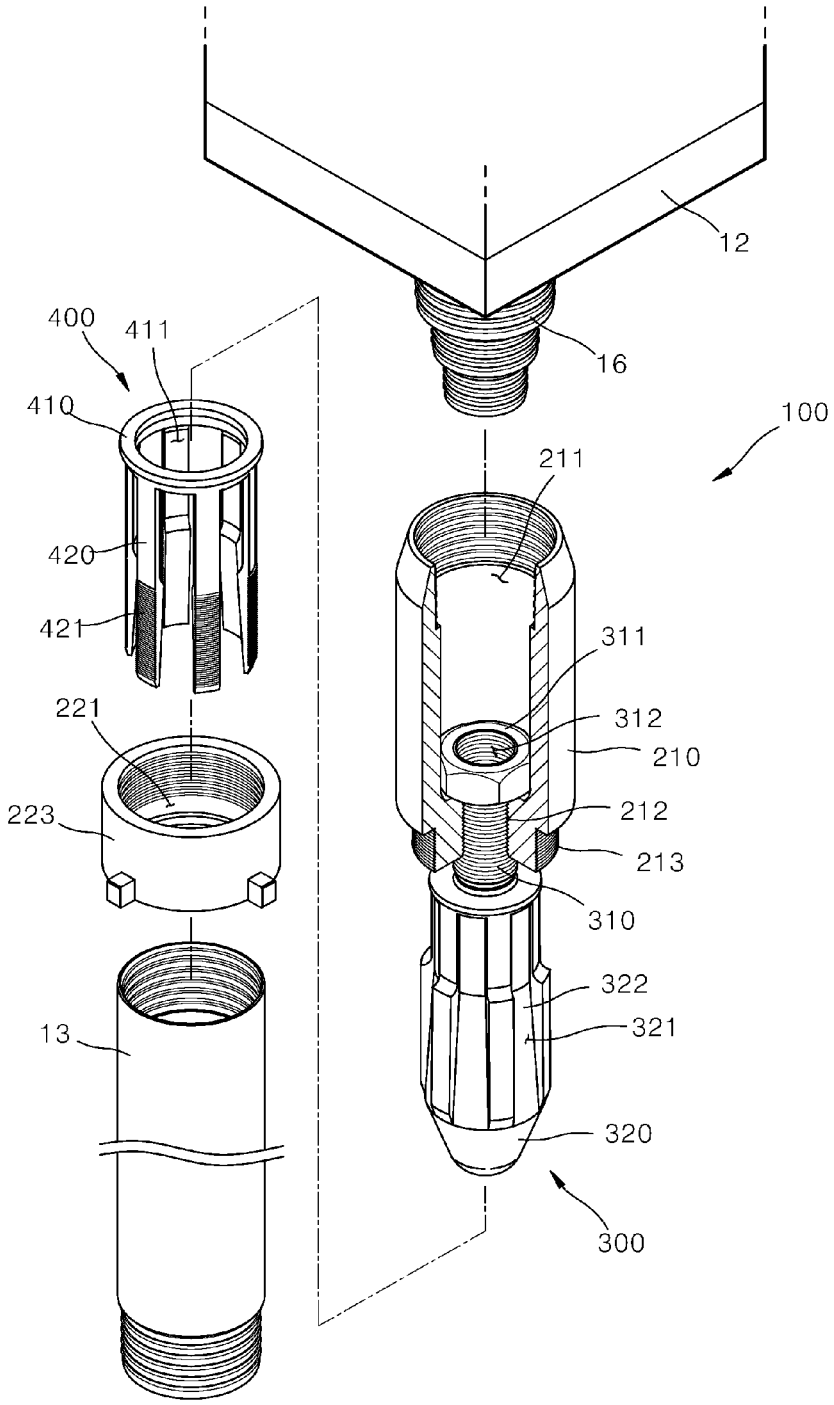
FIG. 2 is an exploded perspective view of the rod clamping device according to the present invention.
Figure 3:
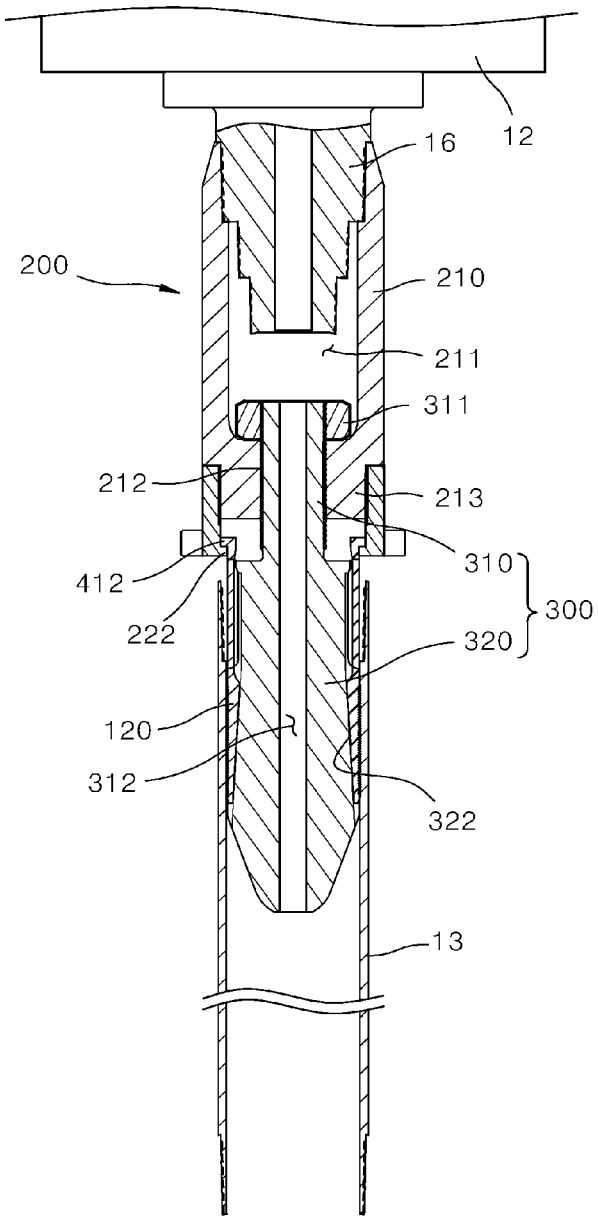
FIGS. 3 and 4 are cross-sectional views illustrating an operational state of the rod clamping device of FIG. 2.
Figure 4:
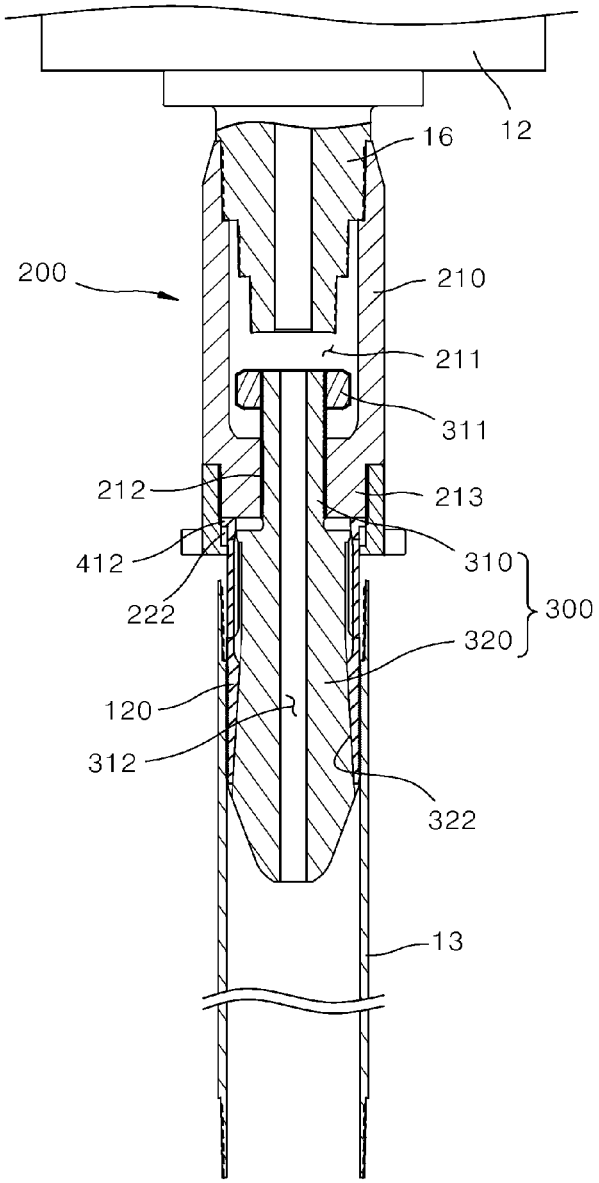

Hereinafter, a rod clamping device according to a preferred embodiment of the present invention will be described in detail with reference to the appended drawings.

FIGS. 1 to 4 illustrate a rod clamping device 100 according to the present invention.

Referring to the drawing, the rod clamping device 100 is a device which clamps a rod 13 to a boring machine 10. The boring machine 10 includes: a body 11, a lead 14 supported by the body 11, a moving frame 15 moving along a length direction of the lead 14; a head part 12 installed at the moving frame 15, a drive shaft 16 installed at the head part 12 and connected to the rod 13 for boring, and a drive unit (not shown) installed at the head part 12 to drive the drive shaft 16.

The moving frame 15 is coupled to a rail (not shown) formed in the length direction at the lead 14 to be movable in the length direction. The moving frame 15 is raised and lowered along the rail by a drive unit, although not shown in the drawings. The drive unit includes a plurality of sprockets installed at each of upper and lower parts of the lead 14, a chain which is hooked on the sprockets and has a side fixed to the moving frame 15, and a hydraulic motor that drives one of the sprockets.

The head part 12 is installed at a front surface of the moving frame 15 and has the drive shaft 16 installed thereon. An outer circumferential surface of a lower end portion of the drive shaft 16 has a male thread to be coupled to the rod clamping device 100. Here, a flow path is formed to pass in an upward and downward direction through the drive shaft 16 to supply a working fluid, that is, water, to a water hammer (not shown) installed at an end of the rod 13.

The rod clamping device 100 according to the present invention will be described in detail below.

The rod clamping device 100 includes a housing 200 coupled to the drive shaft 16, a locking member 300 screw-coupled to the housing 200 so as to move forward and backward according to forward and reverse rotations of the housing 200 coupled to the drive shaft 16, a supporting part 410 supported by the housing 200, and a collet unit 400 extended from the supporting part 410 so as to be inserted into a hollow part of the rod 13, and including a plurality of collet parts 420 for holding and releasing the rod 13 according to the forward and backward movements of the locking member 300.

The housing 200 includes a main body 210 screw-coupled to the lower end portion of the drive shaft 16 and a sub body 223 coupled to a lower part of the main body 210.

The main body 210 has a cylindrical shape with a predetermined outer diameter and extends in the upward and downward direction. The main body 210 has an inner space 211 with an open upper part, and an upper inner wall surface thereof has a female thread to be screw-coupled to the drive shaft 16.

Furthermore, the main body 210 has a fastening hole 212 formed to penetrate therein in the upward and downward direction so that the locking member 300 may be coupled to the center of the bottom of the inner space 211. Here, it is preferable that the inner surface of the fastening hole 212 has a female thread to be screw-coupled to the locking member 300. A coupling part 213 of which the outer circumferential surface has a male thread is formed at a lower end portion of the main body 210 to be screw-coupled to the sub body 223.

Meanwhile, although not shown in the drawings, a coupling pin may be installed to pass through the main body 210 and the drive shaft 16 so that the main body 210 rotates with the drive shaft 16.

The sub body 223 has a cylindrical shape with a predetermined outer diameter and extends in the upward and downward direction. A sub space 221 is provided to penetrate a central part of the sub body 223 in the upward and downward direction. A female thread is formed on a lower inner wall surface of the sub body 223 to be screw-coupled to the coupling part 213 of the main body 210. Furthermore, a hooking protrusion 222 is formed on a lower end portion of the sub body 223 to support the collet unit 400 to be rotatable.

The hooking protrusion 222 protrudes toward the center of the sub space 221 at the lower end portion of the sub body 223 and extends along a circumferential direction of the sub body 223. A supporting projection of the supporting part 410, which will be described below, is seated on an upper surface of the hooking protrusion 222 so that a supporting part 410 is supported by the sub body 223 to be rotatable with respect to a center line of the length direction.

The locking member 300 includes a screw-coupling part 310 screw-coupled to the housing 200 to be able to move forward and backward along the length direction of the lead, and a collet interference part 320 extended toward a lower part of the screw-coupling part 310 to be coupled to the collet unit 400.

The screw-coupling part 310 has an outer diameter corresponding to an inner diameter of the fastening hole 212 of the main body 210, and extends in the upward and downward direction. An outer circumferential surface of the screw-coupling part 310 has a male thread to be screw-coupled to the fastening hole 212 of the main body 210.

Furthermore, a separation prevention member 311 having an area larger than that of the fastening hole 212 is installed on an upper end portion of the screw-coupling part 310. A fastening hole is formed at a central part of the separation prevention member 311 to be screw-coupled to the screw-coupling part 310. Meanwhile, although not shown in the drawings, a fixing pin is installed to pass through the separation prevention member 311 and the screw-coupling part 310 to fix the separation prevention member 311 and the screw-coupling part 310.

Moreover, a supply channel 312 is formed to pass in the upward and downward direction through the central part of the screw-coupling part 310 to supply a working fluid to the water hammer installed at the end portion of the rod 13.

The collet interference part 320 extends downward at the lower end portion of the screw-coupling part 310 to protrude toward the lower side of the sub body 223 when the screw-coupling part 310 is coupled to the main body 210, and has an outer diameter corresponding to an inner diameter of the rod 13. A plurality of guide grooves 321 extending in a forward and backward movement direction of the locking member 300 are formed at an outer circumferential surface of the collet interference part 320 so that the collet parts 420 may be introduced therein.

The guide groove 321 is introduced inward from the outer circumferential surface of the collet interference part 320 and has a width corresponding to a width of the collet part 420 to guide the collet parts 420.

Furthermore, contact surfaces 322 of the guide grooves 321 contacting inner surfaces of the collet parts 420 are obliquely formed at a predetermined angle with respect to a center line of a forward-and-backward direction of the locking member 300 so that the collet parts 420 approach or are spaced apart from a center of the locking member 300 in accordance with the forward and backward movement of the locking member 300. That is, the guide groove 321 are obliquely formed to gradually approach the center line of a forward-and-backward direction of the collet interference part 320 toward the top to enable the collet parts 420 to be spaced apart toward an outer side of the collet interference part 320 so that the collet unit 400 holds the rod 13 when the locking member 300 moves upward.

Meanwhile, although not shown in the drawings, the guide groove 321 may be formed to be gradually spaced apart from the center line of the forward-and-backward direction toward the top. It is preferable that the plurality of guide grooves 321 are formed to be spaced apart from each other along a circumferential direction of the collet interference part 320 to correspond to the collet parts 420.

Here, a part of the collet interference part 320 spaced apart downwardly with respect to the guide groove 321 has an outer diameter that becomes smaller toward the lower part to be easily introduced into an introduction hole 411 of the supporting part 410, which will be described below.

The supporting part 410 is formed in a ring shape having the introduction hole 411 at a center thereof for the collet interference part 320 to be introduced thereto. A support projection is formed on an upper end portion of the supporting part 410 to be supported by the hooking protrusion 222 of the sub body 223. A bottom surface of the support projection is formed in a direction away from the center of the introduction hole 411 to be seated on the top of the hooking protrusion 222. The supporting part 410 is rotatably supported by the support projection at the sub body 223.

The collet parts 420 extend downwardly at a lower part of the supporting part 410, and a plurality thereof are formed to be spaced apart from each other along a circumferential direction of the supporting part 410. A plurality of anti-slip protrusions 421 are formed on the outer circumferential surface of the collet parts 420 to prevent slipping with respect to an inner circumferential surface of the rod 13.

Furthermore, inner surfaces of the collet parts 420 are obliquely formed to protrude gradually toward the center of the introduction hole 411 toward the top to move along the contact surface 322 and move toward the outer side of the collet interference part 320 when the locking member 300 moves upward. Here, it is preferable that the inner surfaces of the collet parts 420 are obliquely formed at an angle corresponding to a tilt angle of the contact surface 322 of the locking member 300 to move in a direction orthogonal to the center line of the forward-and-backward direction of the locking member 300 in accordance with the forward and backward movement of the locking member 300.

Here, the outer circumferential surfaces of the collet parts 420 are extended in parallel to the center line of the forward-and-backward direction of the collet interference part 320 to expand the contact surface with respect to the inner surface of the rod 13.

Meanwhile, although not shown in the drawings, when the guide groove 321 is formed to be far away from the center line of the forward-and-backward direction of the collet interference part 320 toward the top, the inner surfaces of the collet parts 420 may be obliquely formed to protrude toward the center of the introduction hole 411 toward a lower part.

An operation of the rod clamping device 100 according to the present invention configured as described above will be described below.

First, the rod clamping device 100 is installed on the boring machine 10 by coupling the housing 200 to the drive shaft 16 provided at the head part 12 of the boring machine 10. Next, the collet part 420 and the locking member 300 are forcedly fitted into a hollow part of the rod 13, of which an end portion is held by the rod mounting device, by moving the head part 12.

When the coupling of the collet parts 420 to the rod 13 is complete, the drive shaft 16 of the head part 12 is rotated in the forward direction. Here, the housing 200 rotates with the drive shaft 16, and the rod 13 is prevented from rotating due to an end thereof being fixed to the rod mounting device. Further, the locking member 300 screw-coupled to the housing 200 is forcedly fitted into the rod 13 and does not rotate, and thus the locking member 300 moves upward when the housing 200 rotates in the forward direction.

When the locking member 300 moves upward, the collet parts 420 are moved in a direction away from the locking member 300 due to the contact surfaces 322 inclined and press the inner surface of the rod 13, and thereby the collet unit 400 holds the rod 13.

Meanwhile, when separating the rod 13 from the rod clamping device 100, the drive shaft 16 of the head part 12 is reversely rotated after the end portion of the rod 13 is held by a holding means such as the rod mounting device. Here, the housing 200 rotates with the drive shaft 16 in a reverse direction, and the locking member 300 forcedly fitted into the rod 13 moves downward in accordance with the rotation of the housing 200.

When the locking member moves downward, the collet parts 420 move toward the inner side of the locking member 300 due to the contact surfaces 322 which are inclined, and thus a state of the collet unit 400 holding the rod 13 is released.

The rod clamping device 100 according to the present invention configured as described above may hold the rod 13 by expanding the outer diameter of the collet unit 400 inserted into the rod 13, and thus can more easily replace the rod 13. In addition, since the rod 13 is coupled to the driving shaft 16 of the head part 12 by the collet unit 400, wear and breakage of the rod 13 and the driving shaft 16 caused by frequent replacement of the rod 13 or excessive fastening of the rod 13 can be prevented.

Figure 5:
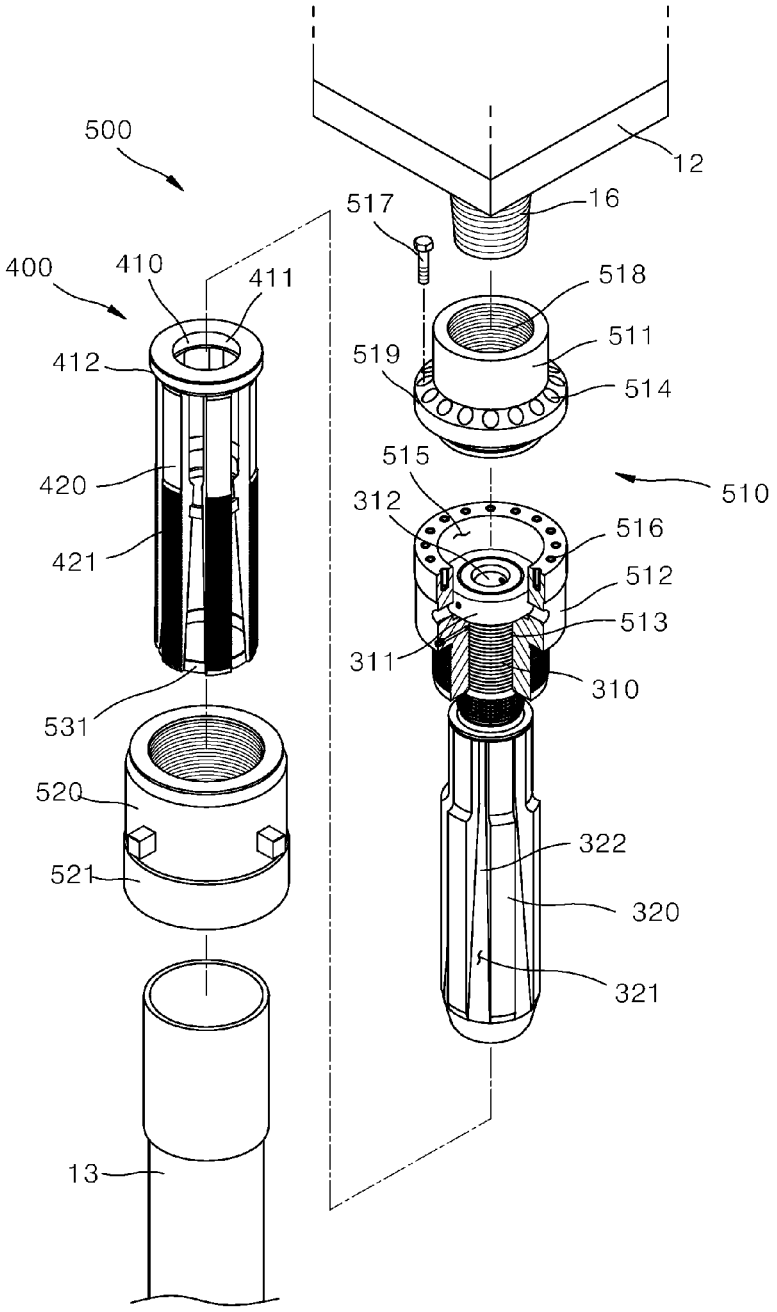
FIG. 5 is an exploded perspective view of a rod clamping device according to another embodiment of the present invention.
Figure 6:
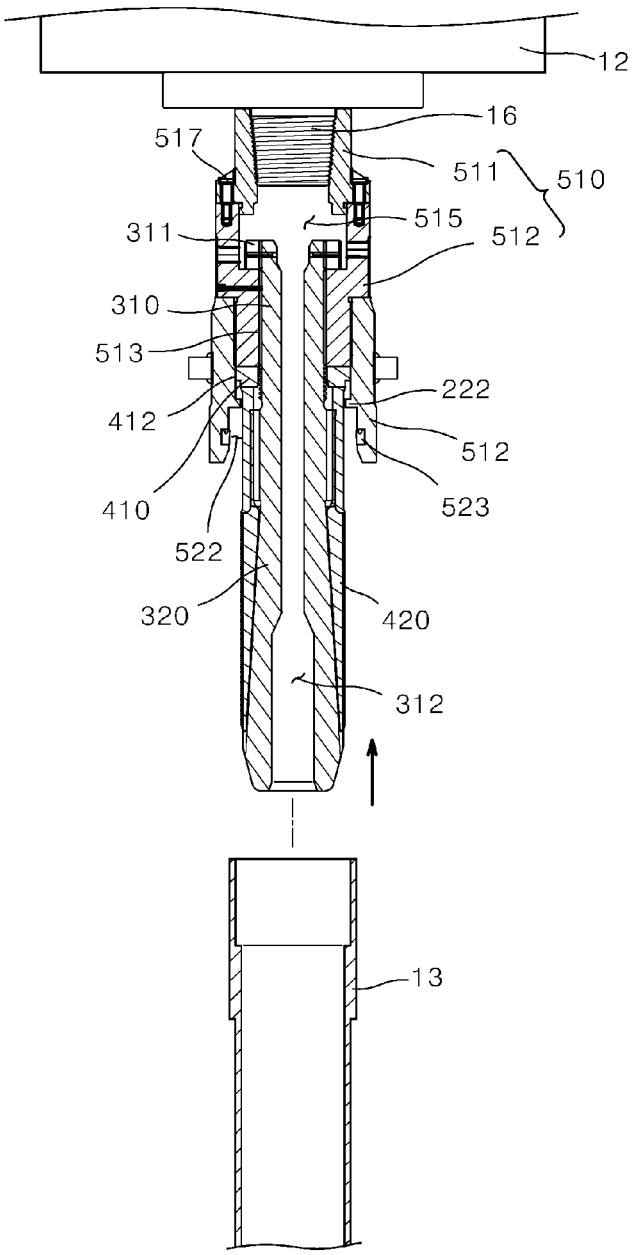
FIGS. 6 and 7 are cross-sectional views illustrating an operational state of the rod clamping device of FIG. 5.
Figure 7:
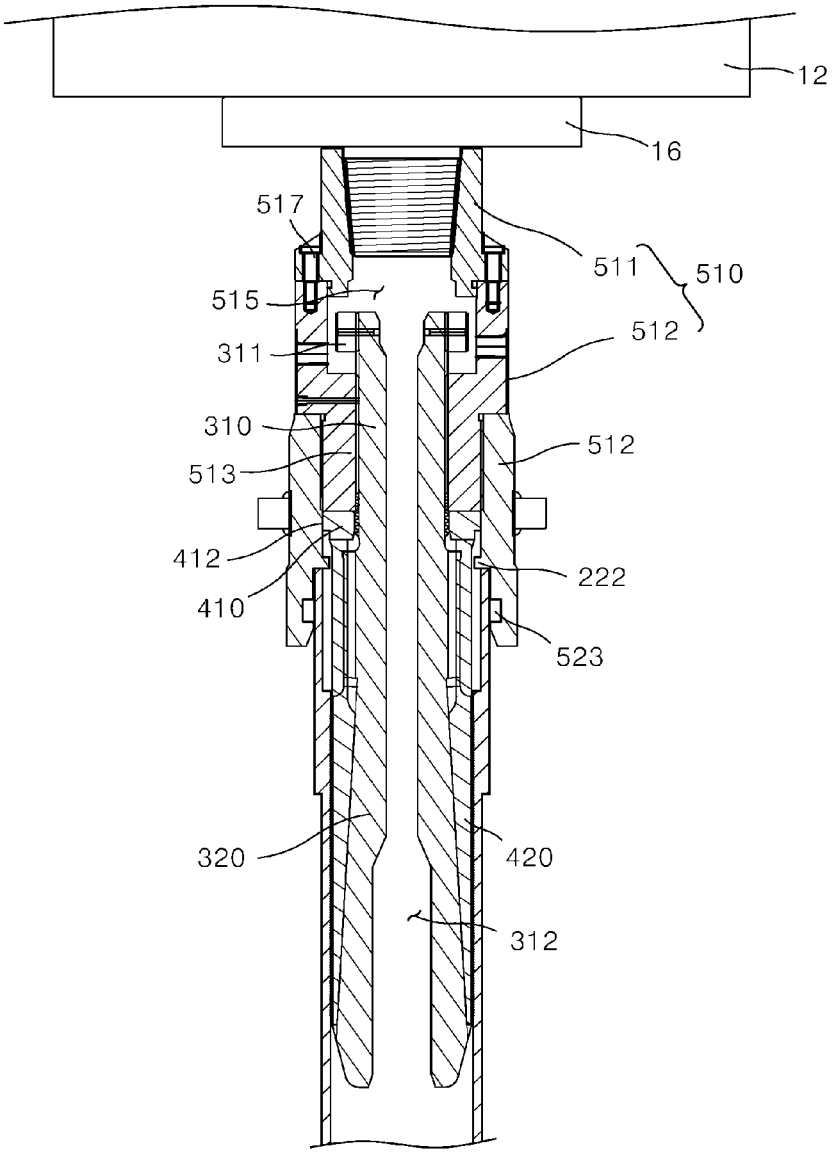

Meanwhile, FIGS. 5 to 7 illustrate a rod clamping device 500 according to another embodiment of the present invention.

The same functional components shown in the previous embodiment are denoted by the same reference numerals.

Referring to the drawing, the rod clamping device 500 includes a first connecting member 511 that enables a main body 510 to be coupled to the drive shaft 16, and a second connecting member 512 detachably coupled to the first connecting member 511 and screw-coupled to the locking member 300.

A coupling hole 518 is formed at the first connecting member 511 to be screw-coupled to the drive shaft 16 of the head part 12. The coupling hole 518 penetrates in an upward and downward direction and has a female thread formed at an inner circumferential surface thereof.

Furthermore, a flange portion 519 is provided at a lower outer circumferential surface of the first connecting member 511. The flange portion 519 protrudes in a direction away from the coupling holes 518 and extends along a circumferential direction at the first connecting member 511. A plurality of a first insertion holes 514 are formed on the flange portion 519 to penetrate therein in the upward and downward direction so that a fixing bolt 517 may be inserted thereinto. The first insertion holes 514 are formed to be spaced apart from each other along a circumferential direction at the flange portion 519.

The second connecting member 512 has an outer diameter corresponding to an outer diameter of the flange portion 519, and has an inner space 515 with an open upper part. Furthermore, the second connecting member 512 has a fastening hole 513 that penetrates therein in the upward and downward direction so that the locking member 300 may be coupled to a center of the bottom of the inner space 515. Here, it is preferable that the inner surface of the fastening hole 513 has a female thread to be screw-coupled to the locking member 300. A coupling part of which an outer circumferential surface has a male thread is formed at a lower end portion of the second connecting member 512 to be screw-coupled to the sub body 520.

Furthermore, a second insertion hole 516 is formed on an upper part of each position of the second connecting member 512 facing the first insertion hole 514 to fasten the fixing bolt 517 penetrating into the flange portion 519. It is preferable that a female thread is formed on an inner circumferential surface of the second insertion hole 516 to be screw-coupled to the fixing bolt 517.

As described above, the main body 510 includes the first connecting member 511 coupled to the drive shaft 16 and the second connecting member 512 coupled to the locking member 300, and the first and second connecting members 511 and 512 are detachably coupled to each other, and thus when the thread of the fastening hole 513 of the first connecting member 511 is worn, it may be used by only replacing the first connecting member 511 from the second connecting member 512 and reduce maintenance and management costs.

Further, an extending part 521 is provided to extend downward at the lower part of the sub body 520. The extending part 521 communicates with the sub space 221, and has a communication hole 522 corresponding to an inner diameter of the rod 13 for the rod 13 to be inserted thereinto.

Meanwhile, a watertight retaining ring 523 is installed at an inner surface of the extending part 521 to maintain water-tightness between an outer circumferential surface of the rod 13 and the inner surface of the extending part 521 when the rod 13 in inserted. It is preferable that the watertight retaining ring 523 is formed of a material having a predetermined elasticity such as urethane, and is formed in a ring shape along the inner surface of the extending part 521.

Furthermore, the collet unit 400 further includes a spacer 531 that is formed at some of the collet parts 420 and supports the collet parts 420 so that the collet parts 420 are spaced apart from each other at a predetermined distance. The spacer 531 extends from the collet part 420 toward adjacent collet parts 420 at the predetermined distance. Here, it is preferable that the spacer 531 is curved with a curvature corresponding to a curvature of the outer circumferential surface of the collet interference part 320.

In the case of separating the rod 13 from the collet unit 400, the collet parts 420 move toward the inner side of the locking member 300 due to the inclined contact surface 322 and are adjacent to each other when the locking member 300 moves toward the lower side of the housing 200 by rotation of the drive shaft 16. Here, since the adjacent collet parts 420 contact an end portion of the spacer 531 and maintain a predetermined interval to be prevented from adhering to the locking member 300, the locking member 300 may be more easily separated from the collet parts 420. Furthermore, the collet parts 420 are adjacent to each other by the spacer 531 and are prevented from being separated from the guide groove 321.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

The invention claimed is:

1. A rod clamping device for clamping a rod to a driving shaft provided at a head part that moves along a lead of a boring machine, comprising:

a housing coupled to the driving shaft;

a locking member screw-coupled to the housing and configured to move forward and backward according to forward and reverse rotations of the housing coupled to the driving shaft, a plurality of guide grooves extended in a forward-and-backward direction of the locking member being formed on an outer circumference surface of the locking member;

a supporting part supported by the housing; and a collet unit extended from the supporting part and inserted into a hollow part of the rod, and including a plurality of collet parts for holding and releasing the rod according to the forward and backward movements of the locking member, the collet parts being introduced into the plurality of guide grooves;

wherein a contact surface of each of the guide grooves which contacts an inner surface of the collet part is obliquely formed at a predetermined angle with respect to a center line of the forward-and-backward direction of the locking member and the collet parts approach or are spaced apart from a center of the locking member in accordance with the forward and backward movement of the locking member.

2. The rod clamping device according to claim 1, wherein a plurality of anti-slip protrusions are formed on outer circumferential surfaces of the collet parts to prevent slipping with respect to an inner circumferential surface of the rod, and an inner surface of each of the collet parts is obliquely formed at an angle corresponding to a tilt angle of a contact surface of the locking member to move in a direction orthogonal to the center line of the forward-and-backward direction of the locking member in accordance with the forward and backward movement of the locking member.

3. The rod clamping device according to claim 1, wherein the housing includes:

a main body which has an end portion coupled to the drive shaft to rotate with the drive shaft and has a fastening hole formed to penetrate therein along a length direction of the lead to be screw-coupled to the locking member; and a sub body which is coupled to the other end portion of the main body and supports the supporting part to be rotatable with respect to a center line of the length direction.

4. The rod clamping device according to claim 1, wherein a supply channel is formed on the locking member to penetrate therein along a length direction of the lead and a working fluid injected through the drive shaft of the head part is supplied to the rod.

* * * * *